US005936515A

United States Patent [19]

Right et al.

[11] Patent Number: 5,936,515

[45] Date of Patent: Aug. 10, 1999

[54] FIELD PROGRAMMABLE VOICE MESSAGE DEVICE AND PROGRAMMING DEVICE

[75] Inventors: Robert Right, Holmes Beach; Jan Braam, Bradenton, both of Fla.

[73] Assignee: General Signal Corporation, Muskegon, Mich.

[21] Appl. No.: 09/060,681

[22] Filed: Apr. 15, 1998

[51] Int. Cl.[6] ..... G08B 3/10

[52] U.S. Cl. ..... 340/384.5; 340/384.1; 340/692

[58] Field of Search ..... 340/384.1, 384.5, 340/692; 379/88.04, 88.18, 88.28, 100.08

[56] References Cited

U.S. PATENT DOCUMENTS

| | | | |
|---|---|---|---|
| 5,291,191 | 3/1994 | Moore | 340/692 |
| 5,349,338 | 9/1994 | Routman et al. | 340/692 |
| 5,495,961 | 3/1996 | Maestre | 221/3 |
| 5,663,714 | 9/1997 | Fray | 340/692 |

OTHER PUBLICATIONS

Installation Instructions for "Adaptone Signal Catalog No. 5530BM–AQ and 5530BM–N5"; 1996; 5 pp.

Information Storage Devices, ISD 1400 Series Product Data Sheets, pp. 59–77.

*Primary Examiner*—Jeffery A. Hofsass
*Assistant Examiner*—Anh La
*Attorney, Agent, or Firm*—Ohlandt, Greeley, Ruggiero & Perle

[57] ABSTRACT

A field programmable audible signal having voice message annunciating capability and a field programming device. The signal has two separate field programming paths. One path includes a built in microphone and the other is a facility to receive a download voice message from a field programming device as by a cable that plugs into both the signal and the programming device. The field programming device is capable of providing either of two messages during a download operation. The field programming device includes a record facility to change at least one of the messages and is small enough to fit in a hand held housing.

11 Claims, 5 Drawing Sheets

FIELD PROGRAMMABLE VOICE MESSAGE DEVICE AND PROGRAMMING DEVICE

FIELD OF INVENTION

This invention relates to audible signals and in particular to a voice message annunciating device that is useful in emergency applications to announce an alarm message.

BACKGROUND OF INVENTION

Audible signals that produce an alarm message in response to the occurrence of an emergency event are well known. In one category, the message is in the form of a pattern of one or more audible tones in continuous or burst format. A drawback to this type of signal is that people who are being warned do not necessarily understand what the alarm signal patterns mean or what they are supposed to do.

Audible signals that produce an alarm voice message overcome this drawback as a voice message can warn of the type of emergency as well as provide instructions for life safety. The voice message is programmed at the factory. To change the message after installation, it has been necessary to remove the signal, reprogram it with a new message and then reinstall it.

When more than one audible signal is installed in the same or overlapping audible areas, it is essential that the signals each have identical voice messages that are played in unison. To have identical voice messages the signals need to be programmed with a single message. To accomplish this, it has been necessary to program the signals at the factory. To change a factory or default message after installation, it has been necessary to remove the installed signals and send them to a facility that has the proper equipment for reprogramming a group of signals with the same message.

An object of the present invention is to provide a new and improved voice message annunciating device that is field programmable.

Another object of the present invention is to provide a voice message annunciating device that is field programmable while installed.

Still another object of the present invention is to provide a field programming device that can be programmed with a new voice message on site which is downloadable to an installed signal.

BRIEF SUMMARY OF THE INVENTION

A field programmable voice message annunciating device embodying the present invention has a voice message record/playback device having a memory for storing the voice message. A switch is operated in response to the occurrence of an event to generate a playback signal that causes the record/playback device to play the stored voice message. Field programming means is operable while the voice message annunciating device is installed to provide a record signal and a new voice message for storage in the memory.

In one embodiment, the field programming means includes a connector which is adapted to receive the record signal and the new message from an external source.

In another embodiment the external source is a field programming device that is capable of providing either of two messages, at least one of which is a field composed, via the connector for downloading. The field programming device has a connector and cord which is electrically coupled to the voice message annunciating device connector for the downloading operation.

BRIEF DESCRIPTION OF THE DRAWINGS

In the accompanying drawings, like reference characters denote like elements of structure.

DESCRIPTION OF PREFERRED EMBODIMENTS

Figure 1:
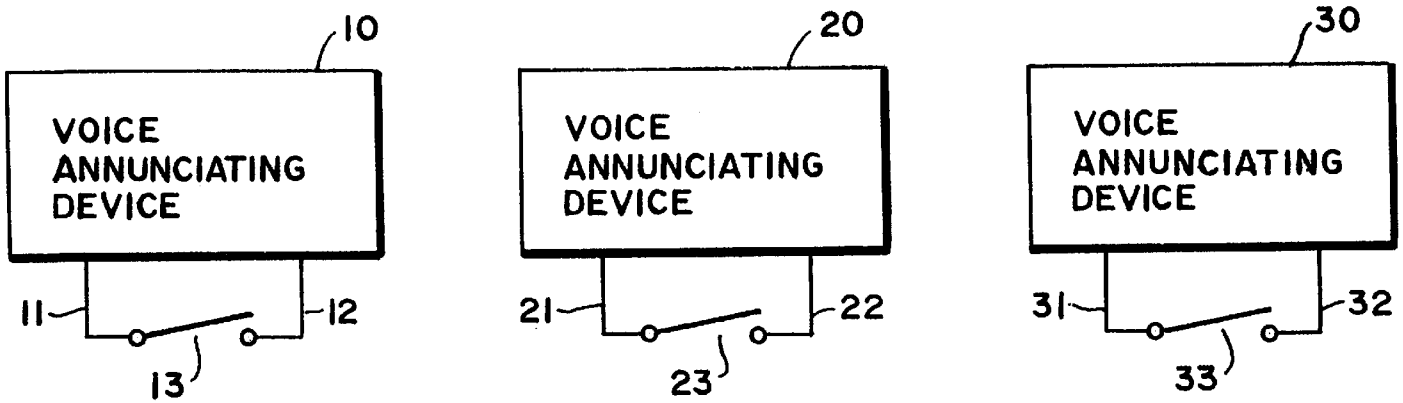
FIG. 1 is a block diagram illustrating an application of a group of voice annunciating devices that are stand alone units.

Voice message annunciating devices embodying the present invention can be used in a variety of applications. FIG. 1 illustrates a plurality of stand alone voice annunciating devices 10, 20 and 30. That is, the application configuration is for individual voice message annunciating devices 10, 20 and 30 to be independent of one another. For example, voice message annunciating devices 10, 20 and 30 might be located in separate areas or rooms of a building.

Voice message annunciating device 10 has input terminals 11 and 12 connected in circuit with a switch 13. Voice message annunciating device 20 has input terminals 21 and 22 connected in circuit with a switch 23. Voice message annunciating device 30 has input terminals 31 and 32 connected in circuit with a switch 33. Switches 13, 23 and 33 are normally open and close in response to the happening of an emergency event. When any of the switches 13, 23 or 33 closes, the associated voice message annunciating device 10, 20 or 30 is activated to play its voice message to its audible area.

Figure 2:
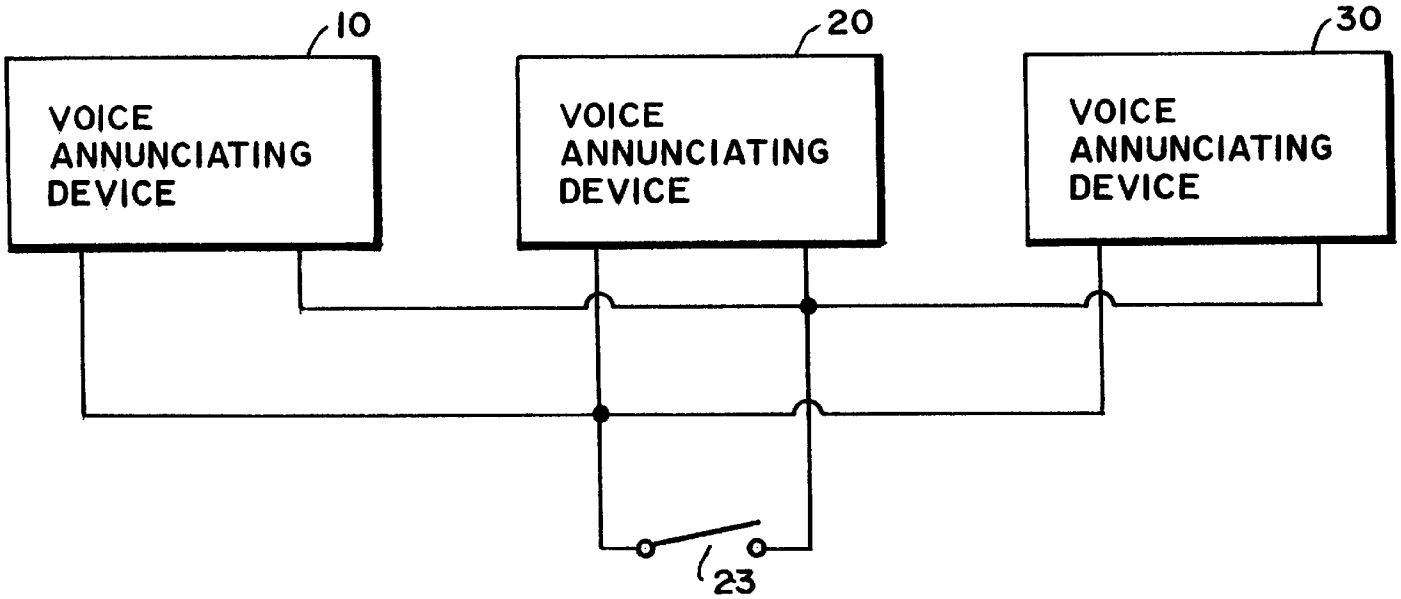
FIG. 2 is a block diagram illustrating another application of a group of voice message annunciating devices.

FIG. 2 illustrates a different application in which voice message annunciating devices 10, 20 and 30 have their input terminals connected in parallel with a single switch 23. In this configuration, a single emergency event activates voice message annunciating devices 10, 20 and 30 for simultaneous broadcast of their respective voice messages. If voice message annunciating devices 10, 20 and 30 are located in overlapping audible areas, it will be desirable for each to contain the same message and operate in unison.

Figure 3:
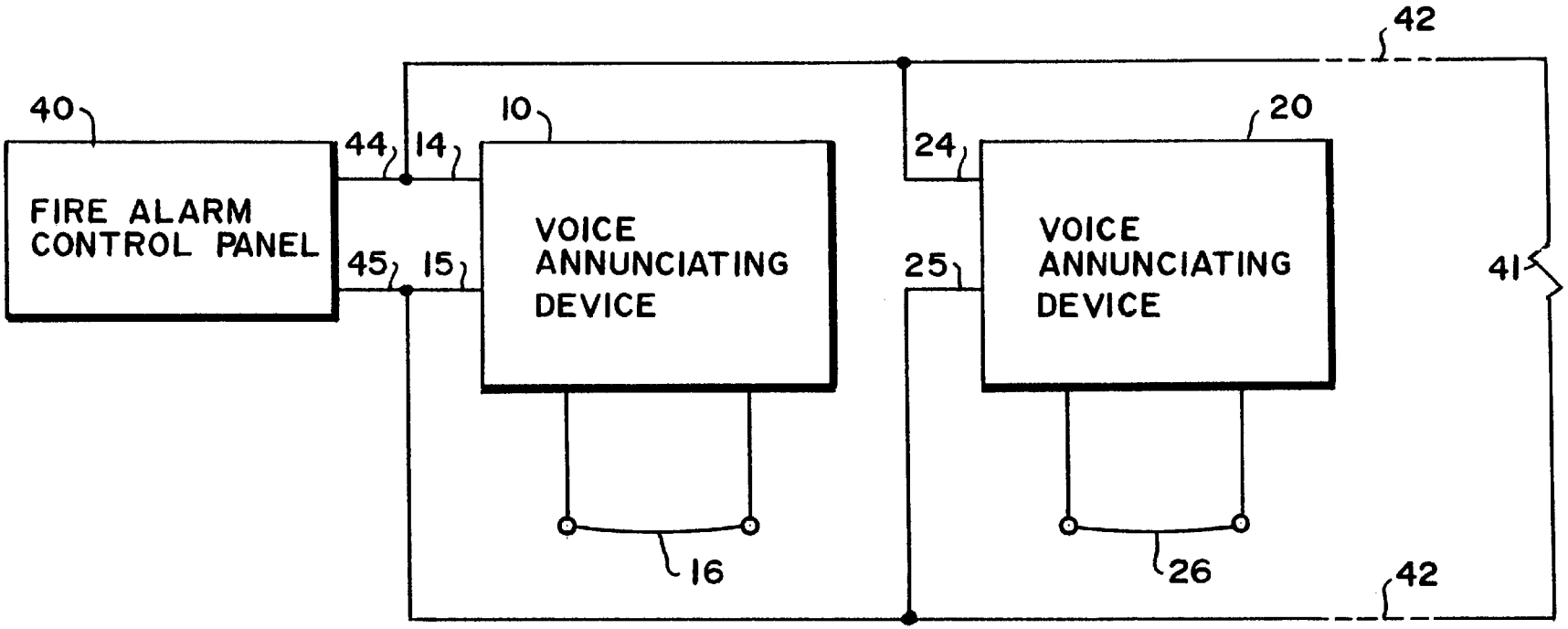
FIG. 3 is a block diagram illustrating still another application of a group of voice message annunciating devices.

FIG. 3 illustrates still another application in which voice message annunciating devices 10 and 20 are configured in a fire signaling environment under control of a fire alarm control panel 40. As indicated by dashed lines 42, additional voice message annunciating devices may be in the configuration but are omitted to avoid clutter of the drawing. In this application, voice message annunciating device 10 has power terminals 14 and 15 and voice message annunciating device 20 has power terminals 24 and 25. Power terminals 14, 15, 24 and 25 are connected in parallel with an end of line resistor 41 and output terminals 44 and 45 of fire alarm control panel 40.

Voice message annunciating devices 10 and 20 have their input terminals shorted by jumpers 16 and 26, but are not activated until fire alarm control panel 40 sends a command signal via its output terminals 44 and 45. The command signal provides operating power for the voice message annunciating devices 10 and 20 and causes them to broadcast their respective voice messages. End of line resistor 41 provides a closed circuit for continuity test purposes.

Figure 4:
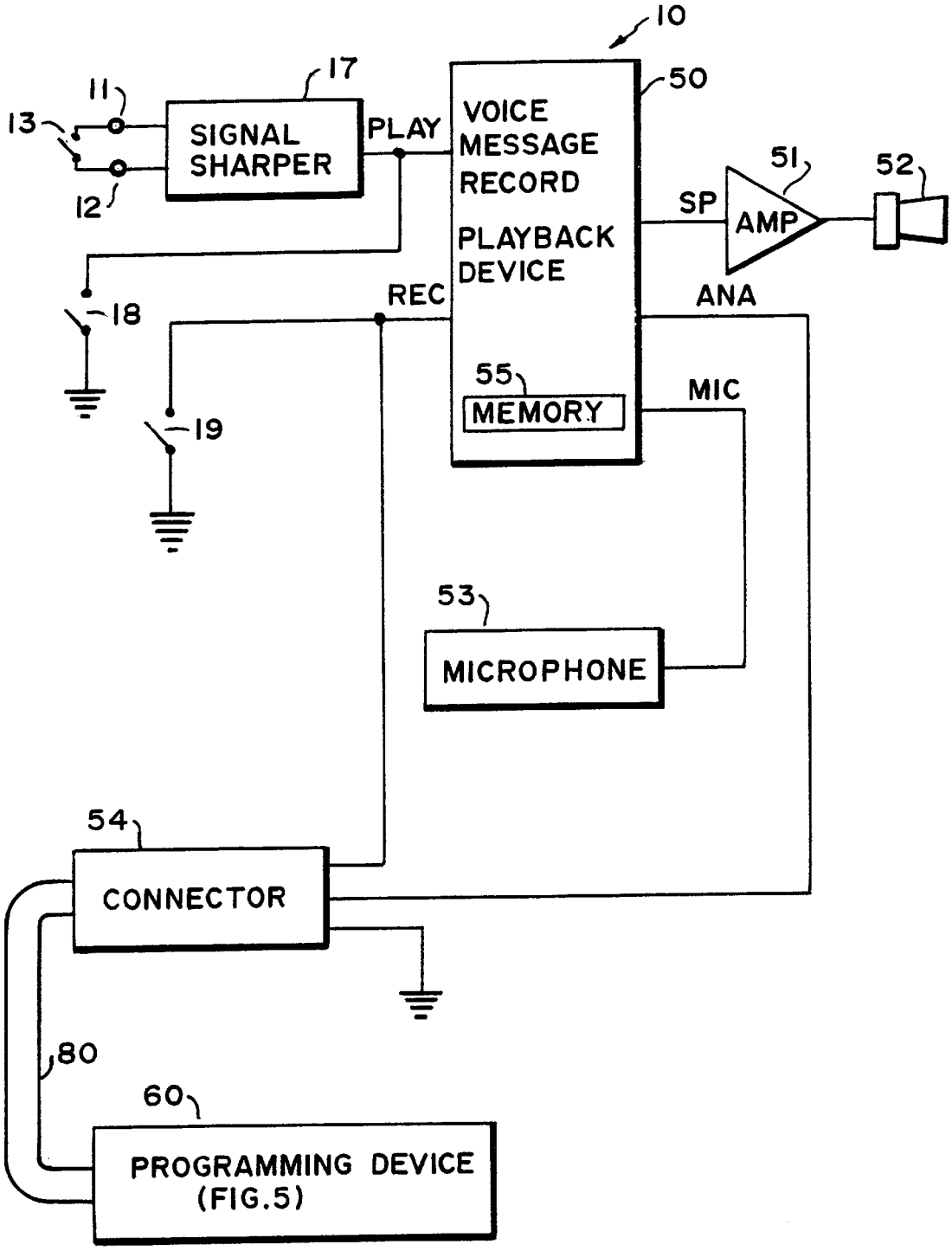
FIG. 4 is a block diagram of a field programmable voice message annunciating device embodying the present invention.

Referring now to FIG. 4, voice message annunciating device 10 has a voice message record/playback device 50 that has an internal memory 55 that stores a voice message. Voice message record/playback device 50 may be any message recorder that has record and playback capability, but is preferably a single chip voice record/playback device, ISD1400 Series, available from Information Storage Devices of San Jose Calif.

Voice message record/playback device 50 has an audio output SP that is applied via an amplifier 51 to a speaker 52. A voice message to be recorded is provided by microphone 53 as an voice message signal MIC to voice message record/playback device 50.

Input terminals 11 and 12 of voice message annunciating device 10 are connected to a signal shaper 17 which serves to shape the signal level and remove any contact bounce transients to provide at its output a playback signal PLAY. The PLAY signal can also be generated by a normally open local play switch 18 which, when closed, produces the PLAY signal. The PLAY signal is applied to voice message record/playback device 50 to place it in a playback mode for playing of a message stored in memory 55 and broadcast thereof via speaker 52 to the audible area of the voice message annunciating device 10.

A normally open local record switch 19 is provided, which, when closed, generates a record signal REC which places voice message record/playback device 50 in a record mode for recording a message in memory 55. For example, record switch 19 is closed when operating microphone 53 for storing a new message in memory 55.

The record signal REC can also be provided via connector 54 from an external programming device 60 via cable 80. Concurrently with providing the record signal REC, programming device 60 downloads a voice message signal ANA for recording in memory 55.

Programming device 60, cable 80 and connector 54 provide a field programming capability for voice annunciating device 10. By locating the connector 54 in an accessible position of the product package of voice message annunciating device 10, cable 80 can be electrically coupled to connector 54, as by a plug, for a downloading operation.

Additional field programming capability is provided by playback and record switches 18 and 19 and microphone 53. These components can be mounted on a single printed circuit board (not shown) together with signal shaper 17, voice message record/playback device 50, amplifier 51 and connector 54. By providing a removable door (not shown) to expose switches 18 and 19, voice message record/playback device 50 can be operated in the record mode to record a new message spoken into microphone 53. The newly recorded message can be listened to by closing local playback switch 18 to produce the PLAY signal for playback.

It is understood that the active components of the voice message annunciating device 10 receive electrical power from a power source, which is not shown in FIG. 4 in order to avoid clutter of the drawing.

Figure 5:
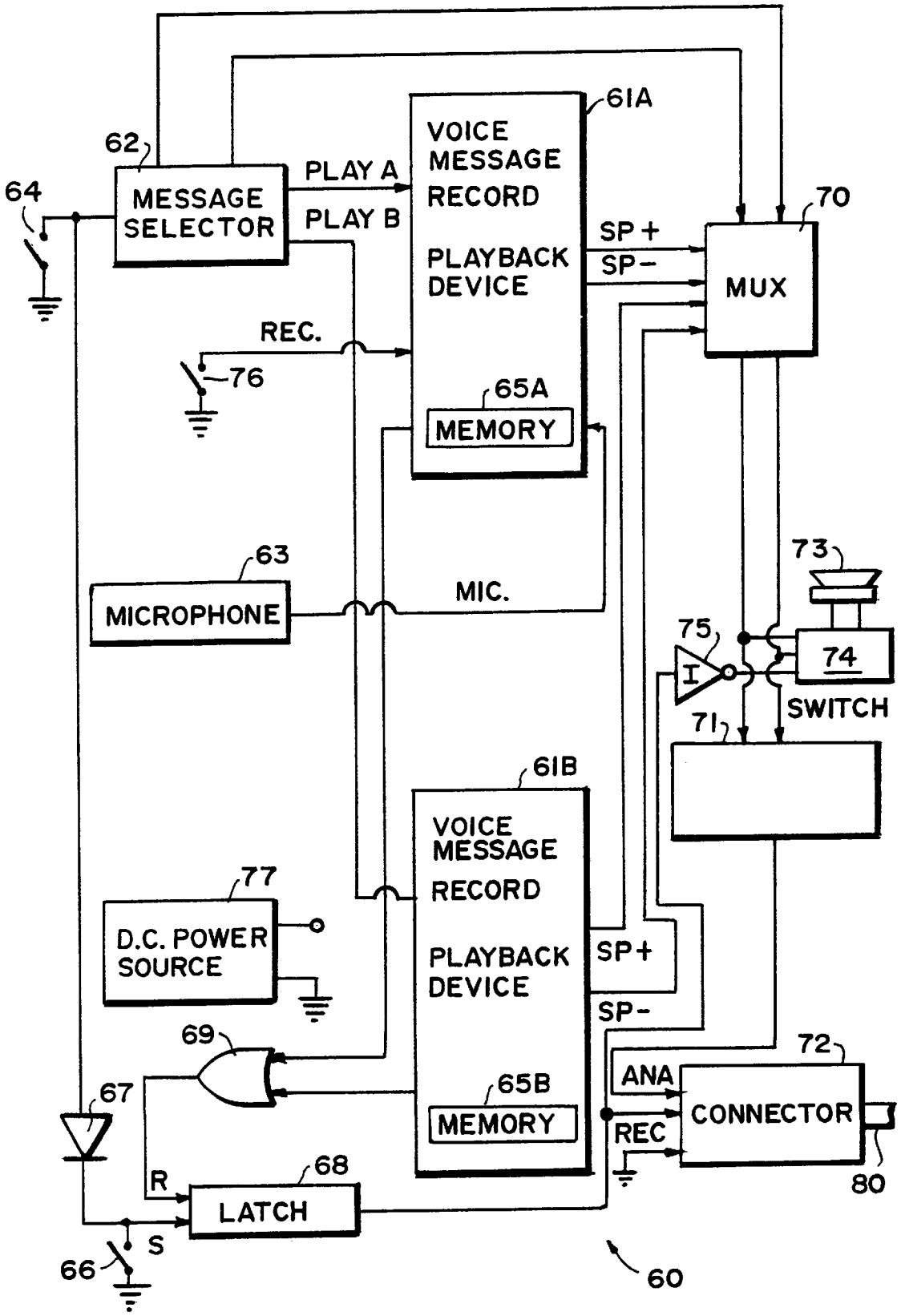
FIG. 5 is a block diagram of a field programming device embodying the present invention.

Referring next to FIG. 5, programming device 60 has voice message record/playback devices 61A and 61B which have memories 65A and 65B that store voice message A and voice message B, respectively. Each voice message record/playback device 61A or 61B may take the form of any message recorder that has record and playback capability, but is preferably single chip voice record/playback device, ISD1400 Series, available from Information Storage Devices of San Jose Calif.

In the illustrated embodiment, voice message record/playback device 61A is programmable with new messages while voice message record/playback device 61B contains a fixed or default message as, for example, a factory generated and prestored message. In other embodiments, both voice message record/playback device 61 A and 61B can be programmable with new messages.

For programming, a normally open master record switch 76, when closed, provides a record signal REC to voice message record/playback device 61A. While master record switch 76 is closed, a voice message spoken into microphone 63 provides a voice message signal MIC which is applied to voice message record/playback device 61A for storage in memory 65A.

Programming device 60 is operable in a local playback mode by closing a normally open playback switch 64. This allows the programmer to listen to either message A or message B. Programming device 60 is also operable in a download mode by closing a normally open download switch 66 to download a selected one of messages A and B.

Message A or B is selected by means of a message selector 62 for playback or a download operation. Message selector 62 is preferably a manually operated double pole double throw switch which in one position applies a playback signal PLAY A to voice message record/playback device 61A and a control signal to a multiplexor (MUX) 70 to select the audio output leads of voice message record/playback device 61A. In the other switch position, a PLAY B signal is applied to voice message record/playback device 61B and a control signal is applied to MUX 70 to select the audio output leads of voice message record/playback device 61B.

During a local playback operation, the programmer can listen to the selected message A or B by means of a speaker 73 which receives the selected voice message A or B via a switch 74.

During a download operation, a latch 68 sets in response to closure of download switch 66 to provide a download signal REC to a connector 72 and via an inverter 75 to switch 74 to disable switch 74 from applying the selected message A or B to speaker 73. When playback or download of the selected message A or B is finished, voice message record/playback device 61A or 61B provides an end of message signal RECLED, which, acting through OR gate 69, resets latch 68, thereby terminating the download control signal REC. A diode 67 prevents closure of the local playback switch 64 from setting latch 68 during a playback operation.

The selected voice message signal from MUX 70 is applied to a compandor 71 to produce a download voice message signal ANA which is applied to connector 72. Compandor 70 may be a low voltage compandor, model NE/SA575A, available from Phillips Semiconductors RF Communications Products of Sunnyvale, Calif.

The field programming device 60 has a d. c. power source 77, for example a battery and associated divider circuitry for providing operating power to the various components of device 60. The circuit connections for distributing this operating power have been omitted to avoid clutter of the drawing.

Figure 6:
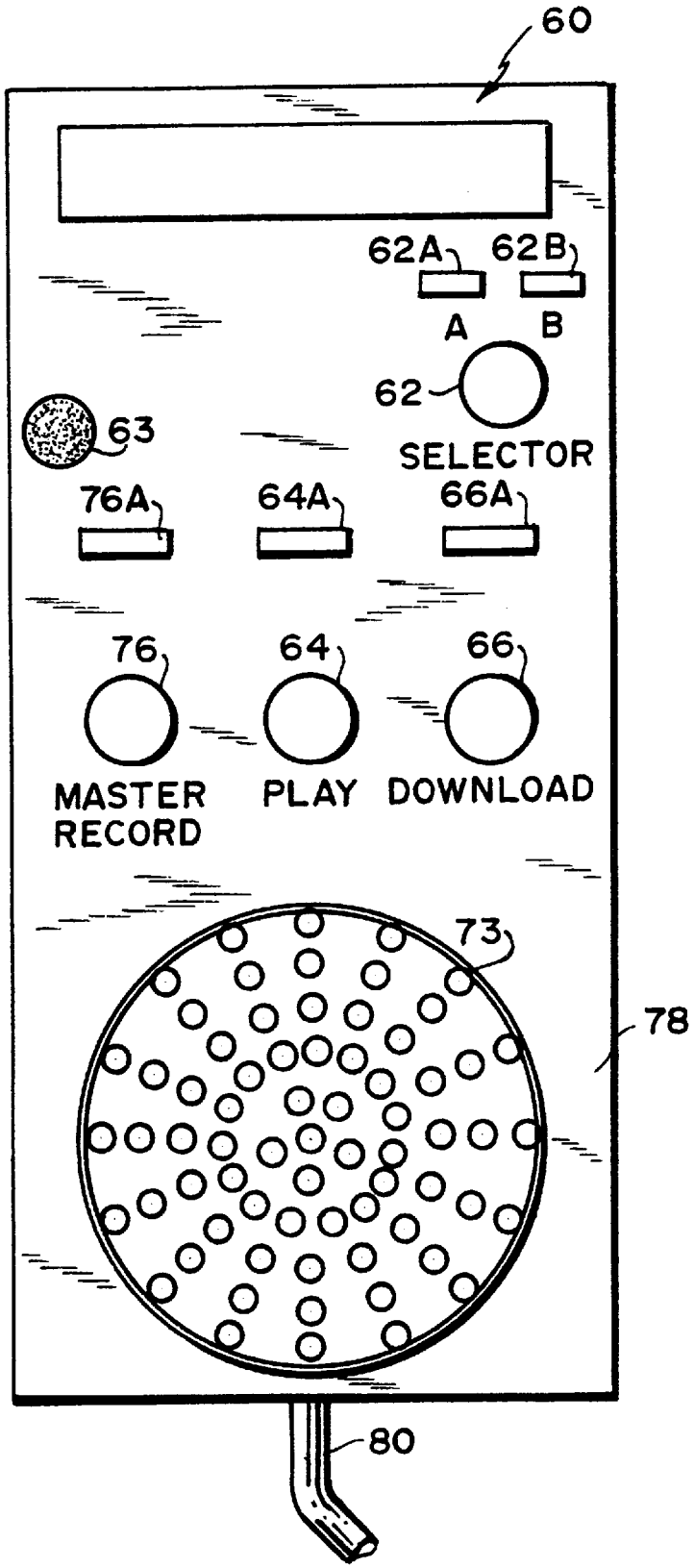
FIG. 6 is a plan view of a hand held housing for the field programming device of FIG. 5.

Referring now to FIG. 6, field programming device 60 is shown to have a hand held housing 78 that contains all of the components illustrated in FIG. 5 except for cable 80. Cable 80 is shown in FIG. 6 extending from the bottom of housing 78 from connector 72 which is not shown in FIG. 6.

Master record switch 76, playback switch 64 and download switch 66 are illustrated simply by circles with accompanying LED indicators 76A, 64A and 66A, respectively, which are lit during record, playback and download.

Selector switch 63 is also illustrated by a circle and has two accompanying LEDS 62A and 62B for indicating the selection of message A or message B.

The field programmable voice message annunciating device and the field programming device embodiments of the present invention are preferred embodiments. Modifications can be made to these illustrated embodiments without departing from the spirit of the invention. Accordingly, the preferred embodiments are illustrative only and are not intended to limit the scope of the invention.

What is claimed is:

1. A field voice message programming device comprising:

first and second voice message units for recording and providing first and second voice messages, respectively;

selector means for selecting one of said first and second voice message units;

record means operable in a record mode for operating said first voice message unit to record a change to said first message;

playback means operable in a playback mode to play said voice message recorded in said selected one of said first and second voice message units;

downloading means operable in a download mode to download said voice message recorded in said selected one of said first and second voice message units as a download voice message signal; and control means for selectively operating said record means in said record mode, said playback means in said playback mode and said download means in said download mode.

2. The field programming device according to claim 1, wherein said control means further comprises:

a download circuit operable to provide a download control signal together with said download voice message signal.

3. The field programming device according to claim 2 wherein said download circuit comprises:

a latch for providing said download control signal when set;

a download switch for setting said latch; and means responsive to an end of message signal produced by said selected one of said first and second voice message units to reset said latch.

4. The field programming device according to claim 3 and further comprising:

a hand held housing containing a battery and said first and second voice message units, selector means, said record means and said download means.

5. The field programming device according to claim 4 wherein said second message is a default message.

6. The field programming device according to claim 1, wherein said control means includes a multiplexer for connecting said voice message recorded in said selected one of said first and second voice message units to said playback means during the playback mode and to said downloading means during the download mode.

7. The field programming device according to claim 6, wherein said control means includes a record switch for enabling said record mode; a playback switch for enabling said playback mode and a download switch for enabling said download mode.

8. The field programming device according to claim 7, wherein said control means is a download circuit operable to provide a download control signal together with said download voice message signal.

9. The field programming device according to claim 8 wherein said download circuit comprises:

a latch for providing said download control signal when set;

said latch being set by said download switch; and means responsive to an end of message signal produced by said selected one of said first and second voice message units to reset said latch.

10. The field programming device according to claim 9 and further comprising:

a hand held housing containing a battery and said first and second voice message units, selector means, said record means and said download means.

11. The field programming device according to claim 10 wherein said second message is a default message.

* * * * *